United States Patent [19]

McCabe

[11] 4,185,658

[45] Jan. 29, 1980

[54] ROTATING BLADE DAMPER

[75] Inventor: Francis J. McCabe, Doylestown, Pa.

[73] Assignee: Prefco Products, Inc., Buckingham, Pa.

[21] Appl. No.: 891,331

[22] Filed: Mar. 29, 1978

Related U.S. Application Data

[63] Continuation-in-part of Ser. No. 764,774, Feb. 2, 1977, Pat. No. 4,114,646, which is a continuation of Ser. No. 689,994, May 26, 1976, Pat. No. 4,081,173, also a continuation-in-part of Ser. No. 770,831, Feb. 22, 1977, Pat. No. 4,113,230 and Ser. No. 729,831, Oct. 4, 1976, Pat. No. 4,113,232, which are continuations-in-part of said Ser. No. 689,994, also a continuation-in-part, of Ser. No. 874,001, Jan. 31, 1978.

[51] Int. Cl.[2] ..... F24F 13/14

[52] U.S. Cl. ..... 137/601; 98/121 A; 251/305

[58] Field of Search ..... 251/305, 308; 137/601; 49/91, 92; 98/110, 121 A

[56] References Cited

U.S. PATENT DOCUMENTS 4,081,173 3/1978 McCabe ..... 251/308

FOREIGN PATENT DOCUMENTS 1454585 3/1969 Fed. Rep. of Germany ..... 98/110

*Primary Examiner*—Robert G. Nilson

*Attorney, Agent, or Firm*—Benasutti Associates, Ltd.

[57] ABSTRACT

A novel rotating blade fire, smoke and air control damper is disclosed wherein integral hook-shaped hinge portions of the damper blades cooperate with integral hook-shaped hinge elements on opposing inwardly depending flanges of the damper frame. The flanges are additionally notched so that hook-shaped ends on the damper blades are capable of creating seals with their adjacent blades across their entire lengths, while top and bottom inwardly depending flanges are offset with respect to the plane of the blades to create seals with the offset tips of the end most blades of the damper when those blades are in the closed position. Finally, at one end of the blades a rectangular notch is formed which, upon rotation of the blade, interfers with a linkage rod disposed adjacent to the frame side wall to define a "full open" position.

10 Claims, 6 Drawing Figures

258
252
200
212
224
232
225
202
214
22
226
234
227
204
216
256
250
28
14
26
262
254
18
206
218
24
16
228
236
229
208
220
20
230
238
231
210
222
260
256

ROTATING BLADE DAMPER

CROSS-REFERENCE TO RELATED APPLICATIONS

The present application is a continuation-in-part of my prior co-pending patent application Ser. No. 764,774, filed Feb. 2, 1977 entitled, "Rotating Blade Fire Damper", now U.S. Pat. No. 4,114,646, which is a continuation of application Ser. No. 689,994, filed May 26, 1976 entitled, "Rotating Blade Fire Damper", now U.S. Pat. No. 4,081,173, dated Mar. 28, 1978, which applications are incorporated by reference as if fully set forth herein.

The present application is also a continuation-in-part of my prior co-pending patent application Ser. No. 770,831, filed Feb. 22, 1977 entitled, "Rotating Blade Fire Damper", now U.S. Pat. No. 4,113,230 and of U.S. patent application Ser. No. 729,831, filed Oct. 4, 1976 entitled, "Smoke, Fire and Air Control Damper With Stamped Blade Hinge", now U.S. Pat. No. 4,113,232 which applications are continuations-in-part of my aforementioned prior co-pending patent application Ser. No. 689,994, filed May 26, 1976, now U.S. Pat. No. 4,081,173, which applications are also incorporated by reference as if fully set forth herein.

The present application is also a continuation-in-part of my prior co-pending patent application Ser. No. 874,001, filed Jan. 31, 1978 entitled, "Multi-Punch, Multi-Die Assembly For Stamping Hook-Shaped Damper Hinge Members", which application is specifically incorporated by reference as if fully set forth herein.

The present application is related to my concurrently filed patent application Ser. No. 891,330, filed Mar. 29, 1978, entitled, "Ecomony, Angle-Blade Damper Kit", which application is specifically incorporated herein by reference as if fully set forth herein.

The present application is also related to my prior issued U.S. Patents including U.S. Pat. No. 3,866,657, dated Feb. 18, 1975 entitled, "Fire Damper", U.S. Pat. No. 3,908,529, dated Sept. 30, 1975 entitled, "Backdraft Damper", U.S. Pat. No. 3,899,156, dated Aug. 12, 1975 entitled, "Single Blade Fire Damper", and U.S. Pat. No. 3,833,989, dated Sept. 10, 1974 entitled, "Method of Fabricating and Assembling a Damper", which patents are specifically incorporated by reference as if fully set forth herein.

BACKGROUND OF THE INVENTION

The present application relates to the field of smoke, fire, and air control dampers.

More particularly, it relates to the field of such dampers wherein no gasketing materials can be used due to the flamability of those materials when impinged by fire and heat.

It has long been a desire of the art of smoke, fire and air control dampers to provide such dampers which are simple, reliable and economical. With spiraling labor costs and substantial increases in the price of steel, these needs are particularly apparent.

SUMMARY OF THE INVENTION

The present invention provides an extremely simple, low cost, and efficient smoke, fire, and air control damper which requires a minimum of expensive tooling and can be fabricated in most sizes utilizing a standard blade stock and simple tooling found in most metal working facilities. The preferred embodiment damper of the present invention comprises a frame having a plurality of inwardly depending flanges. Two of these inwardly depending flanges are disposed in a single plane and have a plurality of hook-shaped hinge elements periodically disposed therealong which have been notched from portions of the flange material. Disposed periodically along these flanges, in between the hook-shaped hinge elements, are additional clearance notches which allow the ends of the hook-shaped edge portions of each blade to extend through the plane of these inwardly depending flanges to create a seal with appropriately disposed members on the other side of the flanges so that seals are created by these hook-shaped end portions along the entire length of these blades.

The preferred embodiment damper frame of the present invention additionally comprises inwardly depending flanges which are offset on opposite sides of the plane of the aforementioned notched flanges. These offset flanges are disposed to create seals with the tips of hook-shaped end portions of the end-most blades, when those blades are in the closed position.

The preferred embodiment damper of the present invention also utilizes a simple, yet effective linkage mechanism which is tucked entirely behind one of the aforementioned inwardly depending, notched flanges. A linkage rod pivotally attached to blade engaging brackets mounted on each of the blades may be maintained in sliding engagement with an interior surface of the damper frame. The configuration of the blade engaging brackets is such that, upon rotation of the damper blades towards the full open position, notches formed in appropriate corners of the blades will allow the hook-shaped end portions of those blades to sweep across a face of the linkage rod. The notches are dimensioned to create interference between the substantially planar faces of the blades and the edge of the linkage rod. In this manner, the tendency of the blade to rotate further is completely negated by reason of the triangular inter-lock which is created between the linkage rod, blade engaging bracket, and blade face.

Accordingly, a primary object of the present invention is the provision of an improved smoke, fire, and air control damper.

A further object of the present invention is the provision of a smoke, fire, and air control damper wherein blades with hook-shaped end portions may create seals with their adjacent blades along their entire lengths.

A further object of the present invention is the provision of a novel damper blade-frame arrangement wherein the hook-shaped end portions of the end most blades of the damper will interact with inwardly depending flanges offset on opposite sides of the plane of the damper to create seals with the tips of said hook-shaped end portions of the end most damper blades.

A further object of the present invention is the provision of a novel blade, blade bracket and linkage rod wherein the hook-shaped end portion of each blade is allowed a sweep across the linkage rod which is then caused to interfere with the substantially planar face of the blade to define a "full open" position.

These and other objects of the present invention will become apparent from the following more detailed description.

DETAILED DESCRIPTION OF THE PREFERRED EMBODIMENT

Figure 1:
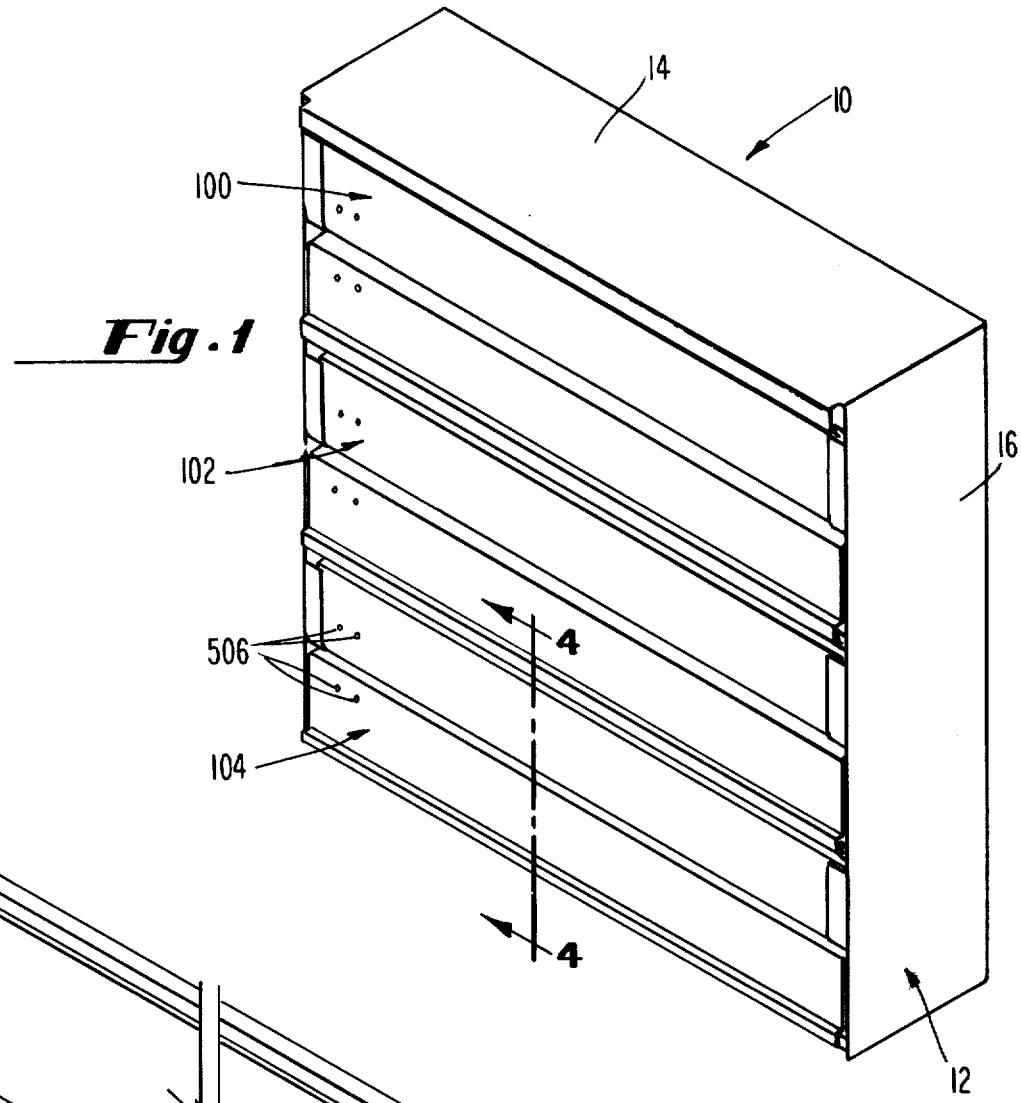
FIG. 1 is a front isometric view of a preferred embodiment damper of the present invention.

Although specific forms of the invention have been selected for illustration in the drawings, and the following description is drawn in specific terms for the purpose of describing these forms of the invention, this description is not intended to limit the scope of the invention which is defined in the appended claims.

Referring now to the figures, the preferred damper, designated generally 10, of the present invention is illustrated in FIG. 1 and is seen to comprise a damper frame designated generally 12 having a plurality of blades mounted therein, designated generally 100, 102, and 104. The damper frame 12 comprises four sides, a top 14, sides 16 and 18, and a bottom 20. In the vicinity of the operating face of the damper, four inwardly depending flanges extend from the sides. Extending within the same plane from sides 16 and 18 are notched flanges, designated generally 24 and 22 respectively. Depending inwardly from top 14 and bottom 20 are top offset flange 26 and bottom offset flange 28 which are offset on opposing sides of the plane defined by notched flanges 22 and 24. The advantages of offsetting these flanges will become apparent from the following description.

Figure 2:
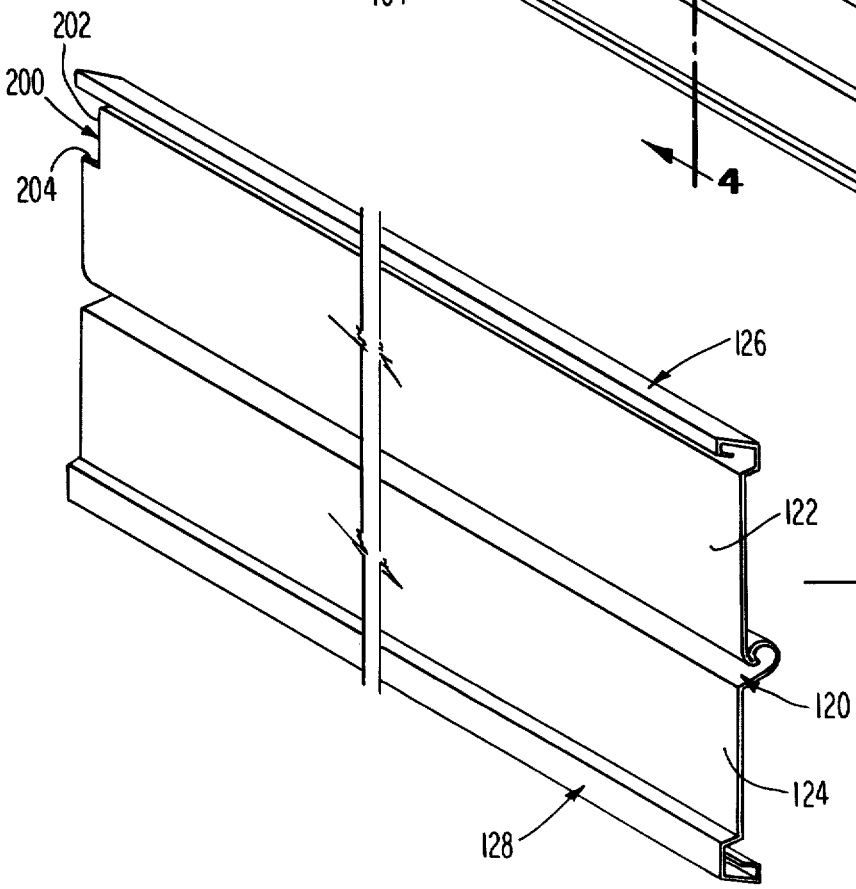
FIG. 2 is a foreshortened blade on a greatly enlarged scale for use in the damper illustrated in FIG. 1.

Referring now in particular to FIG. 2, each of the blades of the preferred embodiment damper comprises a hook-shaped hinge portion designated generally 120, two blade faces 122 and 124 (which are offset with respect to each other by the thickness of the notched flanges), and two hook-shaped end portions designated generally 126 and 128 extending longitudinally for the length of this blade. As seen in FIG. 2, each of these blades is uniform in its entire length except for a blade clearance notch designated generally 200 which defines a clearance edge 202 and an interference edge 204 which interact with the linkage rod of the damper, as described hereinafter. With the exception of the aforementioned notch 200, the preferred embodiment blade as illustrated in FIG. 2, including the hook-shaped hinge portion 120, and end hook-shaped end portions 126 and 128 may be configured as described in my prior co-pending patent application Ser. No. 764,774, filed Feb. 2, 1977 entitled, "ROTATING BLADE FIRE DAMPER", which has been incorporated by reference herein.

Figure 3:
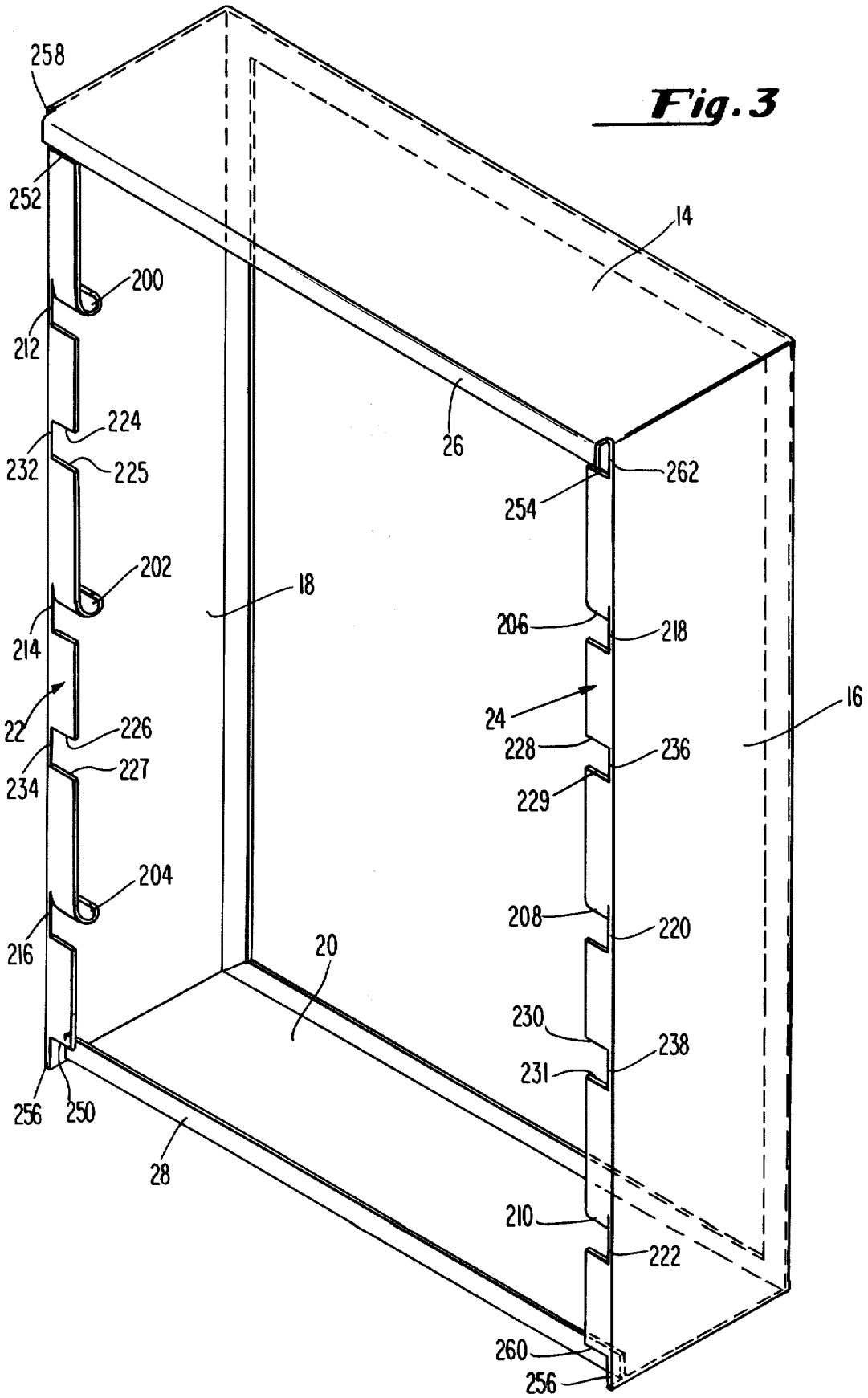
FIG. 3 is an isometric view of the frame of the preferred embodiment damper illustrated in FIG. 1, showing in particular the interrelationship between the notched, offset and inwardly depending flanges thereof.
Figure 4:
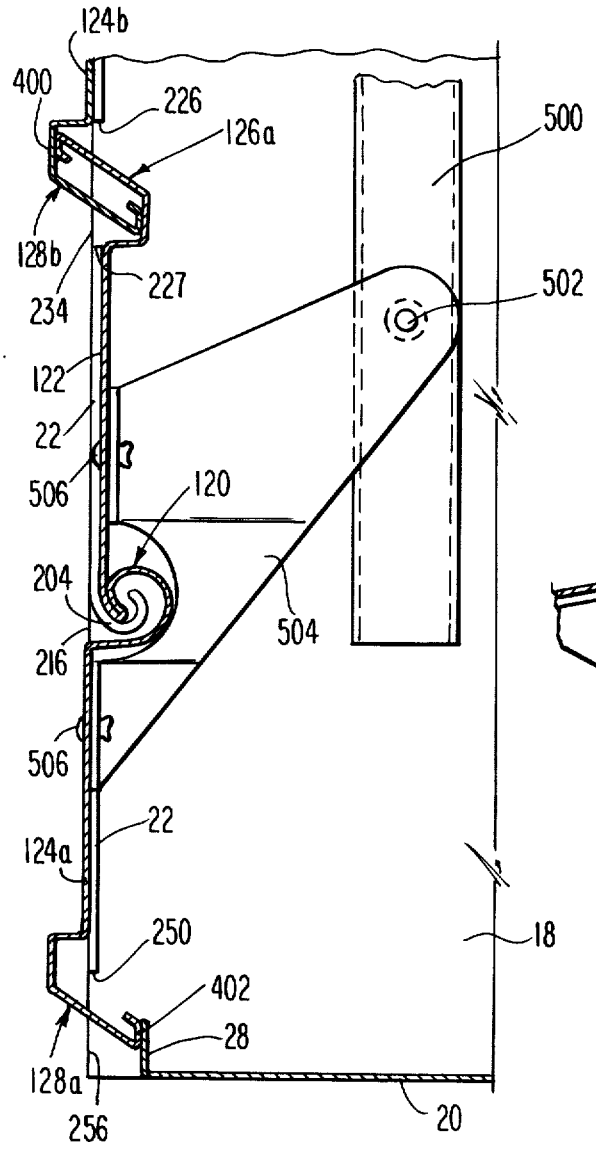
FIG. 4 is a fragmentary cross-section on an enlarged scale of a portion of the damper illustrated in FIG. 1, taken as indicated by the lines and arrows 4—4 in FIG. 1.

Referring now in particular to FIG. 3, which is an illustration of the preferred embodiment damper frame, notched flanges 22 and 24 are seen to comprise a plurality of hook-shaped hinge elements 200, 202, 204, 206, 208 and 210. These hook-shaped hinge elements are preferably preformed by notching and forming them from portions of the flange while leaving a slight amount of material in the vicinity of the notches adjacent to the notches to form blade guidance flanges 212, 214, 216, 218, 220 and 222. These blade guidance flanges insure that the ends of the blades may not rub up against the interior surfaces of side walls 16 or 18 during the rotation of the blades. Notched flanges 22 and 24 additionally comprise a plurality of periodically spaced clearance notches alternatively spaced with respect to the aforementioned hook-shaped hinge elements. These clearance notches are defined by upper transverse clearance notch edges 224, 226, 228 and 230, lower transverse clearance notch edges 225, 227, 229 and 231, and clearance notch guide flanges 232, 234, 236 and 238. In addition to these clearance notches, at the upper and lower ends of notched flanges 22 and 24 terminal notches are defined by transverse edges 250 and 252 for notched flange 22 and 254 and 256 for notched flange 24. These terminal notches are also defined by terminal guide flanges 256, 258, 260 and 262. Unlike the guide flanges associated with the hinge elements, the clearance notch guide flanges and terminal notch guide flanges cooperate with the blades only as the blades move towards and into into the closed position to aid in laterally aligning the blades with respect to the damper opening. In FIG. 4, the interrelationship between two blades, clearance and terminal notches, and an offset flange is clearly illustrated. Referring now in particular to the lower left hand corner of the drawing in FIG. 4, blade face **124*a* (which blade is in the closed position) matingly engages the outer surface of flange 22. This blade face 124*a* terminates in a hook-shaped end portion 128*a*, clearance for which is provided by the notch defined between terminal notch transverse edge 250, and terminal guide flange 256 which may slidingly engage the edge of the hook-shaped edge portion 128 as the blade is moved to the fully closed position, as shown in FIG. 4. In the closed position, the tip 402 of the hook-shaped end portion 128*a* creates a seal along its entire length with offset inwardly depending flange 28. It should be noted that the plane of inwardly depending flange 28 is offset from the plane of notched flange 22 by a distance which is equal to the offset between blade face 124*a* and blade tip 402. Referring now to the other end of this blade, blade face 122 is seen to engage and create a seal with respect to the other surface of notched flange 22 and to similarly terminate in a hook-shaped end portion designated generally 126*a*. Along this edge of the blade, however, the hook-shaped end portion 126*a* creates a seal with an opposing hook-shaped end portion 128*b* of an adjacent blade. In the closed position, both of these hook-shaped end portions have clearance provided for them at their ends by the clearance notches defined in the notched flanges. In FIG. 4, this clearance notch is defined by upper and lower transverse clearance notch edges 126 and 127 and by clearance notch guide flange 234, which may slidingly engage the edges of these hook-shaped end portions as the blades are moved into their fully closed position. During the full arc of rotation of the blade, however it is guide flange 216 associated with hinge element 204 which may slidingly engage the hook-shaped hinge portion 120** at any time during the rotation of that blade to aid in aligning the blade with respect to the frame.

Figure 5:
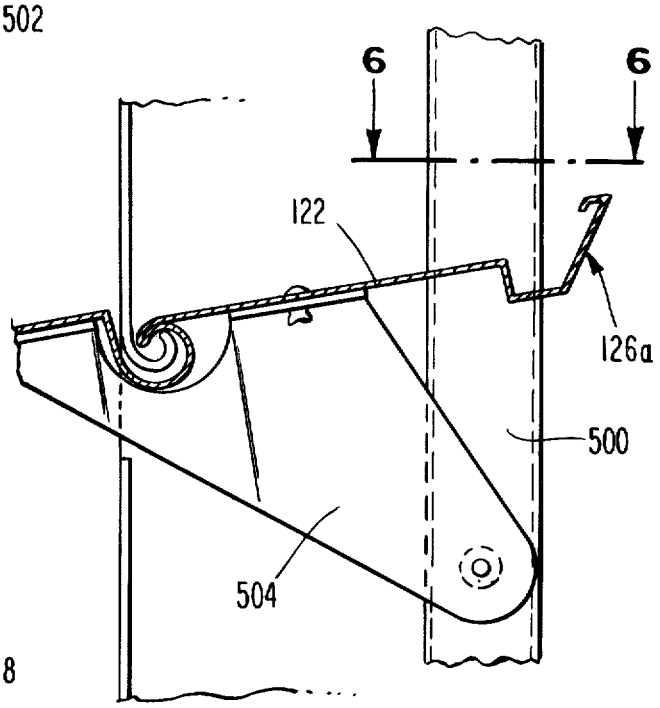
FIG. 5 is a fragmentary view of a portion of that portion of the damper illustrated in FIG. 4, showing the linkage rod, blade engaging bracket and blade in the "full open" position.
Figure 6:
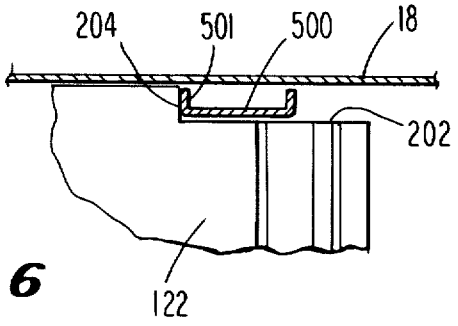
FIG. 6 is a top cross-section of a portion of the apparatus illustrated in FIG. 5, taken as indicated by the lines and arrows 6—6 in FIG. 5.

Referring now in particular to FIGS. 4, 5, and 6, the novel linkage means of the present invention for articulating each blade with respect to the remaining blades in the damper is illustrated. The linkage basically comprises a linkage rod 500 which is pivotally connected through linkage rod pivot pin 502 to blade engaging bracket 504 which is fixedly attached to blade faces 124a and 122 by rivets 506. Blade engaging bracket 504 is oriented so that linkage rod 500 is disposed adjacent to the interior surface of side wall 18 and may, if preferred, slide thereagainst. Although it would be possible to extend the blade engaging bracket 504 so that, upon rotation of the blade towards the open position, as shown in FIG. 5, no interference was effected between the linkage rod 500 and any portion of the blades, excessive force, if applied either to the blades or the linkage rods could, conceivably, bend the hook-shaped hinge portion or hook-shaped hinge elements, thereby possibly damaging the damper. It is also conceivable that blade engaging bracket 504 could be extended to a point where the linkage rod 500, upon rotation of the blade, interferes with the hook-shaped end portion of the blades to prevent further opening of those blades. In this configuration excessive forces which might be exerted by the linkage rod on the hook-shaped end portions of the blade could conceivable distort the configuration of those hook-shaped end portions to thereby adversely affect the sealing characteristics of those portions as they coact with adjacent blades. To the contrary, in the preferred embodiment the blade clearance notch designated generally 200 is configured to allow the hook-shaped end portion of each of the blade to sweep across a face of the linkage rod upon opening of the blade towards the full open position. The blade engaging bracket 504 is configured to orient the linkage rod in a position such that when the blades are in their full open position, an interference as created between blade interfering surface 204 and an edge 501 of linkage rod 500. In the event that continuing pressure is applied in attempt to further open the blade pass this point, the forces created thereby will be exerted in vectors which are substantially coincident with the planes of the blade engaging bracket 504, blade face 122, and the face of linkage rod 500. Each of these members is well adapted to resist such forces, thereby creating an extremely strong "triangular" blade stop.

From the above description it will be seen that a simple, efficient, and low cost damper is obtained which possesses many advantages over those heretofore known to the art.

It will be understood that various changes in the details, materials and arrangement of parts which have been herein described and illustrated in order to explain the nature of this invention may be made by those skilled in the art within the principle and scope of the invention as expressed in the following claims.

It will further be understood that the "Abstract of the Disclosure" set forth above is intended to provide a non-legal technical statement of the contents of the disclosure in compliance with the Rules of Practice of the United States Patent and Trademark Office, and is not intended to limit the scope of the invention described and claimed herein.

What is claimed is:

1. In a damper comprising a frame, at least one blade, and rotation means for allowing selective rotational displacement of said blade between a closed and an open position with respect to said frame, the improvement wherein said frame comprises an inwardly depending flange having a plurality of clearance notches defined therein and wherein at least one longitudinal edge of said blade is configured to form a hook-shaped portion, the tip of said hook-shaped portion being configured to extend across said flange through at least one of said clearance notches when said blade is in the closed position.

2. The invention of claim 1 wherein said damper comprises a plurality of blades, at least one longitudinal edge of each of said blades being configured to form a hook-shaped portion, the tip of each of said hook-shaped portions of each of said blades being configured to extend across said flange through at least one of said clearance notches when said blades are in the closed position.

3. The invention of claim 2 wherein at least portions of said opposing hook-shaped portions of adjacent blades of said damper extend through at least one of said clearance notches to engage complimentally configured portions of said blades to create seals with said adjacent blades in the vicinity of said clearance notch.

4. The invention of claim 1 wherein said frame comprises at least one additional inwardly depending flange offset from the plane of said flange having said plurality of clearance notches defined therein, and wherein said at least one blade has at least one longitudinal edge thereof configured to form a hook-shaped portion, the tip of said hook-shaped portion being configured to engage said offset flange when said blade is in the closed position.

5. The invention of claim 4 wherein a plurality of said additional flanges is provided, said additional flanges being provided on opposing sides of said flange having said clearance notches defined therein.

6. The invention of claim 1 wherein said flange having said plurality of clearance notches defined therein further defines terminal notches at each of the ends thereof, and wherein said at least one blade has at least one longitudinal edge thereof configured to form a hook-shaped portion, the tip of said hook-shaped portion being configured to extend across said flange through said terminal notch when said blade is in the closed position.

7. In a damper comprising a frame, a plurality of blades, rotation means for allowing selective rotational displacement of said blades between a closed and an open position with respect to said frame, and linkage means for articulating the relative rotational positions of said blades with respect to each other and with respect to said frame, the improvement wherein said linkage means comprises at least one blade engaging bracket for engaging each of said blades, at least one linkage rod pivotally attached to each of said blade engaging brackets, and stop means defined in each of said blades for allowing the longitudinal end portions thereof to sweep across at least a portion of said linkage rod as said blade is moved towards the full open position, and for interfering with said linkage rod as said blade reaches the full open position.

8. The invention of claim 7 wherein each of said blades comprises at least one longitudinal edge which is configured to form a hook-shaped end portion, and wherein said blade is configured to define at least one notch therein, said notch being adapted to receive upon rotation of said blade towards the open position at least a portion of said linkage rod, at least one edge of said notch interfering with said linkage rod as said blade is moved to the full open position.

9. The invention of claim 7 wherein said blade engaging bracket and said linkage rod are oriented in planes substantially perpendicular to the plane of said blade.

10. The invention of claim 9 wherein the plane of said blade in the full open position is substantially perpendicular to the axis of said linkage rod when said blade is in the full open position.

* * * * *